US007456578B2

(12) United States Patent
Heckmann et al.

(10) Patent No.: US 7,456,578 B2
(45) Date of Patent: Nov. 25, 2008

(54) CIRCUIT ARRANGEMENT HAVING PROTECTIVE CIRCUIT AND MODIFICATION APPARATUS

(75) Inventors: Markus Heckmann, Munich (DE); Thomas Siegmund, Otterfing (DE)

(73) Assignee: Patent-Treuhand-Gesellschaft fur Ellectrische Gluhlampen mbH, Munich (DE)

( * ) Notice: Subject to any disclaimer, the term of this patent is extended or adjusted under 35 U.S.C. 154(b) by 265 days.

(21) Appl. No.: 11/340,675

(22) Filed: Jan. 27, 2006

(65) Prior Publication Data

US 2006/0170372 A1 Aug. 3, 2006

(30) Foreign Application Priority Data

Feb. 3, 2005 (DE) ..... 10 2005 005 058

(51) Int. Cl.
*H05B 37/00* (2006.01)

(52) U.S. Cl. ..... 315/119; 315/120; 315/291

(58) Field of Classification Search ..... 315/119–128, 315/291–311
See application file for complete search history.

(56) References Cited

U.S. PATENT DOCUMENTS 3,580,681 A * 5/1971 Robert et al. ..... 356/365
5,581,161 A * 12/1996 Gong ..... 315/307
6,605,908 B1 * 8/2003 Zhang et al. ..... 315/307

* cited by examiner

*Primary Examiner*—Tuyet Vo
*Assistant Examiner*—Jae K Kim
(74) *Attorney, Agent, or Firm*—Carlo S. Bessone

(57) ABSTRACT

A circuit arrangement has a drive circuit for a lamp having a first connection for a first filament of the lamp and a second connection for a second filament of the lamp, a protective circuit, coupled on the output side to the drive circuit and on the input side to the first connection for the first filament and the second connection for the second filament such that a first signal correlated with an operational parameter of the first filament, and a second signal, correlated with an operational parameter of the second filament, can be transmitted to the protective circuit. The arrangement also includes a modification apparatus connected between the protective circuit and the first connection and/or the second connection, the apparatus designed to modify the first signal and/or the second signal and to make them available to the protective circuit as a modified first signal and/or a modified second signal.

5 Claims, 2 Drawing Sheets

CIRCUIT ARRANGEMENT HAVING PROTECTIVE CIRCUIT AND MODIFICATION APPARATUS

FIELD OF THE INVENTION

The present invention relates to a circuit arrangement having a drive circuit for a lamp having a first connection for a first filament of the lamp and a second connection for a second filament of the lamp, a protective circuit, which is coupled on the output side to the drive circuit and on the input side to the first connection for the first filament of the lamp and the second connection for the second filament of the lamp such that a first signal, which is correlated with an operational parameter of the first filament, and a second signal, which is correlated with an operational parameter of the second filament, can be transmitted to the protective circuit.

BACKGROUND OF THE INVENTION

Such a circuit arrangement is known. A brief explanation will be given in order to illustrate the problem on which the invention is based: The present invention is concerned with the end-of-life problem of lamps having two filament electrodes. Owing to an inhomogeneous material loss of the two filaments, at some point in time the emission capability of one filament compared with that of the other filament decreases. This results in the so-called cathode drop, and the resistance of a filament and thus the voltage across this filament increase compared with the corresponding variables for the other filament. This corresponds in terms of effect to the introduction of a rectification effect. This rectification effect leads on the one hand to an undesirably high load on the drive circuit, which is often in the form of an electronic ballast, and on the other hand leads to heat generation which is restricted to a very small area. In particular in the case of narrow fluorescent tubes, a heat concentration may occur which may lead to melting or breaking of the lamp. In order to establish this rectification effect, it is known to evaluate the ratio of positive and negative peaks of the lamp voltage in a protective circuit. A typical protective circuit comprises, as an essential element, an ASIC from Infineon having the designation ICB1LB01G. If it is established in the module that the ratio exceeds a predeterminable threshold value, operation of the lamp is ended.

The disadvantage of this known circuit arrangement consists in the fact that the threshold value is fixed and nevertheless filament and lamp breakages occur when using this module with different lamp types.

SUMMARY OF THE INVENTION

The present invention is therefore based on the object of developing the circuit arrangement mentioned initially such that filament and lamp breakages can be reliably prevented when using one and the same protective circuit for different lamp types.

The invention is based on the knowledge that the ratio of positive and negative peaks of the lamp voltage does not represent a reliable measure for the heat converted in the lamp. In other words, this ratio may trigger disconnection at the correct point in time in the case of a first lamp type, but, in the case of another lamp type, disconnection would have had to have taken place at a much earlier point in time in order to rule out the negative consequences mentioned.

The disadvantage with the mentioned protective circuit consists in the fact that the threshold value is not variable but is fixed in the ASIC. Even when other conceivable operational parameters of the lamp are evaluated, for example the peak value and the DC component of the lamp voltage, a threshold fixed in the protective circuit would rule out use of one and the same protective circuit for different lamp types. The present invention is based in particular on the knowledge that, owing to suitable signal processing upstream of the protective circuit, it is possible in a simple manner to adapt to the respective lamp type, which on the one hand leads to prevention of oversensitivity or lack of sensitivity in the end-of-life disconnection and on the other hand allows for the universal use of one and the same protective circuits for different lamp types.

A circuit arrangement according to the invention therefore also comprises a modification apparatus which is connected between the protective circuit and the first connection and/or the second connection, the modification apparatus being designed to modify the first signal and/or the second signal and to make them available to the protective circuit as a modified first signal and/or a modified second signal. The modification apparatus is preferably designed in terms of the permissible asymmetry power of the lamp type used and the characteristic data of the lamp type used.

One preferred embodiment is characterized in that the modification apparatus is designed to split the first signal and/or the second signal into the DC component and the AC component for the purpose of providing the modified first signal and/or the modified second signal. The modification apparatus is also preferably designed to apply different weightings to the DC component and the AC component of the respective signal for the purpose of providing the modified first signal and/or the modified second signal. In order to increase the sensitivity, the DC component may, for example, be given a greater weighting than the AC component. In order to reduce the sensitivity, precisely the reverse procedure may be adopted.

In order to split the signal into the DC component and the AC component or to achieve the desired weighting, passive or active filters may be used.

One particularly preferred embodiment is characterized in that the modification apparatus is designed to carry out frequency-dependent weighting.

Furthermore, the modification apparatus preferably has an interface in order to make it possible for an operator to input at least one parameter for the modification, i.e. in order to specify the type of modification. It is thus possible to adapt to the respective lamp type in a simple manner. As an alternative, modification apparatuses matched to the respective lamp types can be provided without such an interface.

Further preferred embodiments are described in the dependent claims.

BRIEF DESCRIPTION OF THE DRAWINGS

One exemplary embodiment will now be described in more detail below with reference to the attached drawings, in which.

DETAILED DESCRIPTION OF THE INVENTION

Figure 1:
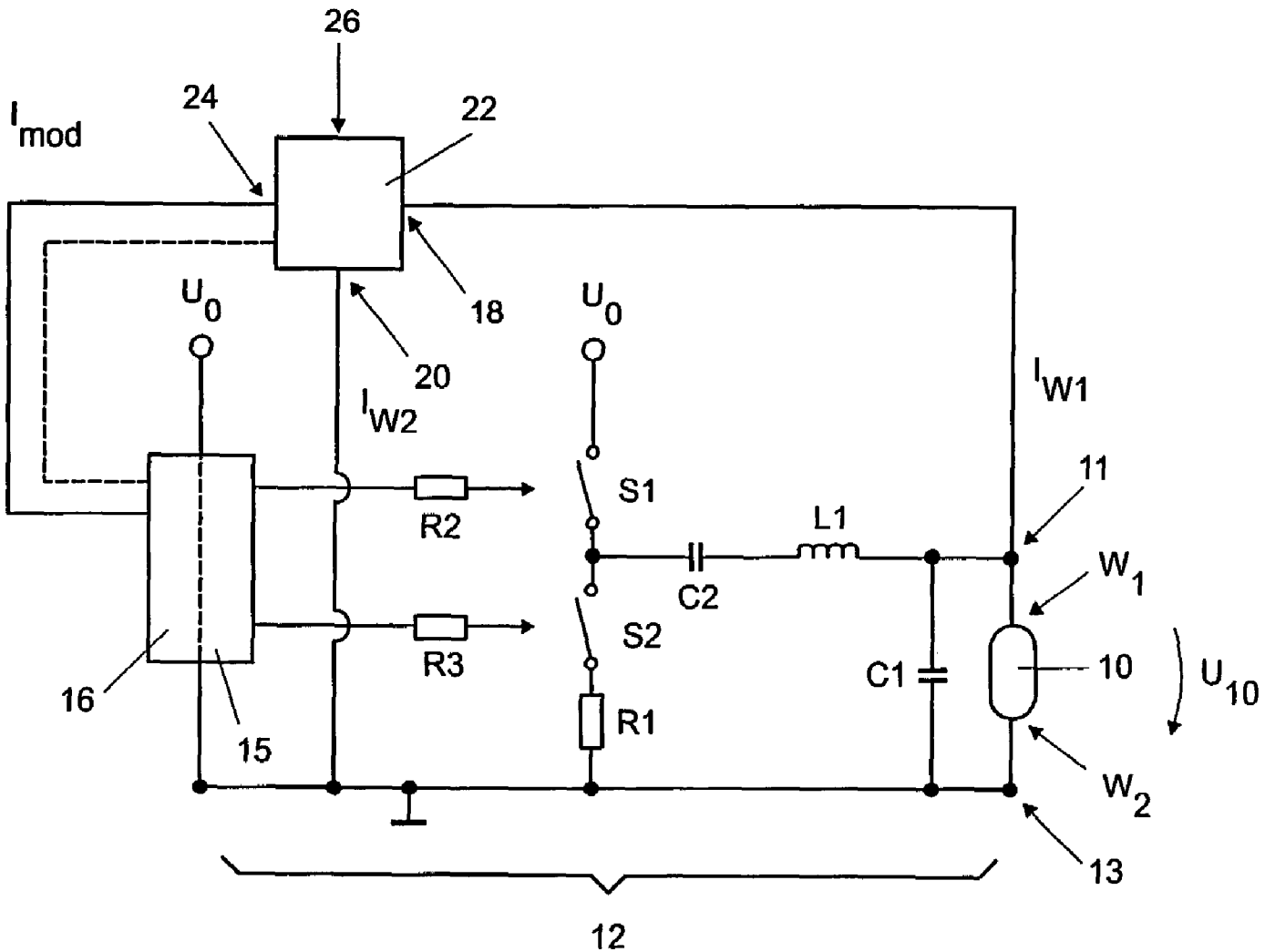
FIG. 1 shows a schematic illustration of one embodiment of a circuit arrangement according to the invention.

FIG. 1 shows one exemplary embodiment of a circuit arrangement according to the invention. Components which are insignificant in the terms of the invention and have long been known to those skilled in the art have been omitted for reasons of improved clarity. FIG. 1 shows a lamp 10, which is connected in parallel with a resonant capacitor C1. A connection, which is connected to a first filament W1 of the lamp 10, is identified by the reference 11. A second connection, which is connected to the second filament W2 of the lamp 10, bears the reference 13.

The series circuit comprising a coupling capacitor C2 and an inductance L1 is arranged in series with the parallel circuit comprising the lamp 10 and the resonant capacitor C1. Said coupling capacitor C2 and inductance L1 are connected to the center point of a half-bridge circuit, which comprises the switches S1 and S2. While the switch S1 is coupled to a supply voltage $U_0$, the switch S2 is connected to ground via a resistor R1. The switches S1 and S2 are driven via resistors R2 and R3 by a controller 15 with a high-frequency signal, i.e. the switches S1 and S2 open and close at a high frequency in push-pull fashion. The controller 15 is likewise connected to a supply voltage $U_0$. The switches S1 and S2, the resistors R1, R2, R3, the capacitors C1 and C2, the inductance L1 and the controller 15 form the drive circuit 12.

A protective circuit 16 is connected between the lamp 10 and the drive circuit 12, is connected on the output side to the drive circuit 12, in this case is provided in a common housing with the controller 12, and whose input is connected to the output of a modification apparatus 22, which has a first input 18 and a second input 20. The inputs 18, 20 are on the one hand coupled to the first filament W1 of the lamp 10 and on the other hand to the second filament W2 of the lamp 10.

The modification apparatus 22 is designed to modify the signal applied to the input 18 and/or to the input 20 and to provide said signal at the output 24 of the protective circuit 22 as a modified first signal and/or a modified second signal. Instead of an output 24, two output connections, which are connected to the protective circuit 16, may of course also be provided at the modification apparatus 22, in which case the modification apparatus 22 is to be connected to the protective circuit 16 by a further line, cf. in this regard the dashed optional line 25. The modification apparatus 22 comprises an interface 26, via which it is possible to adapt to the respectively used type of lamp 10. In particular, the interface 26 can be used to establish the manner in which the signals applied to the inputs 18 and 20 should be modified in order to provide them at the output 24 in modified form.

In the exemplary embodiment illustrated, the modification apparatus 22 is designed, for example, to split the signal applied to the inputs 18 and 20 into the DC component and the AC component, to apply different weightings to the DC component and the AC component and to provide the signal at the output 24 in this modified form. The time multiplex method may be used to provide the two modified signals on a line.

Figure 2:
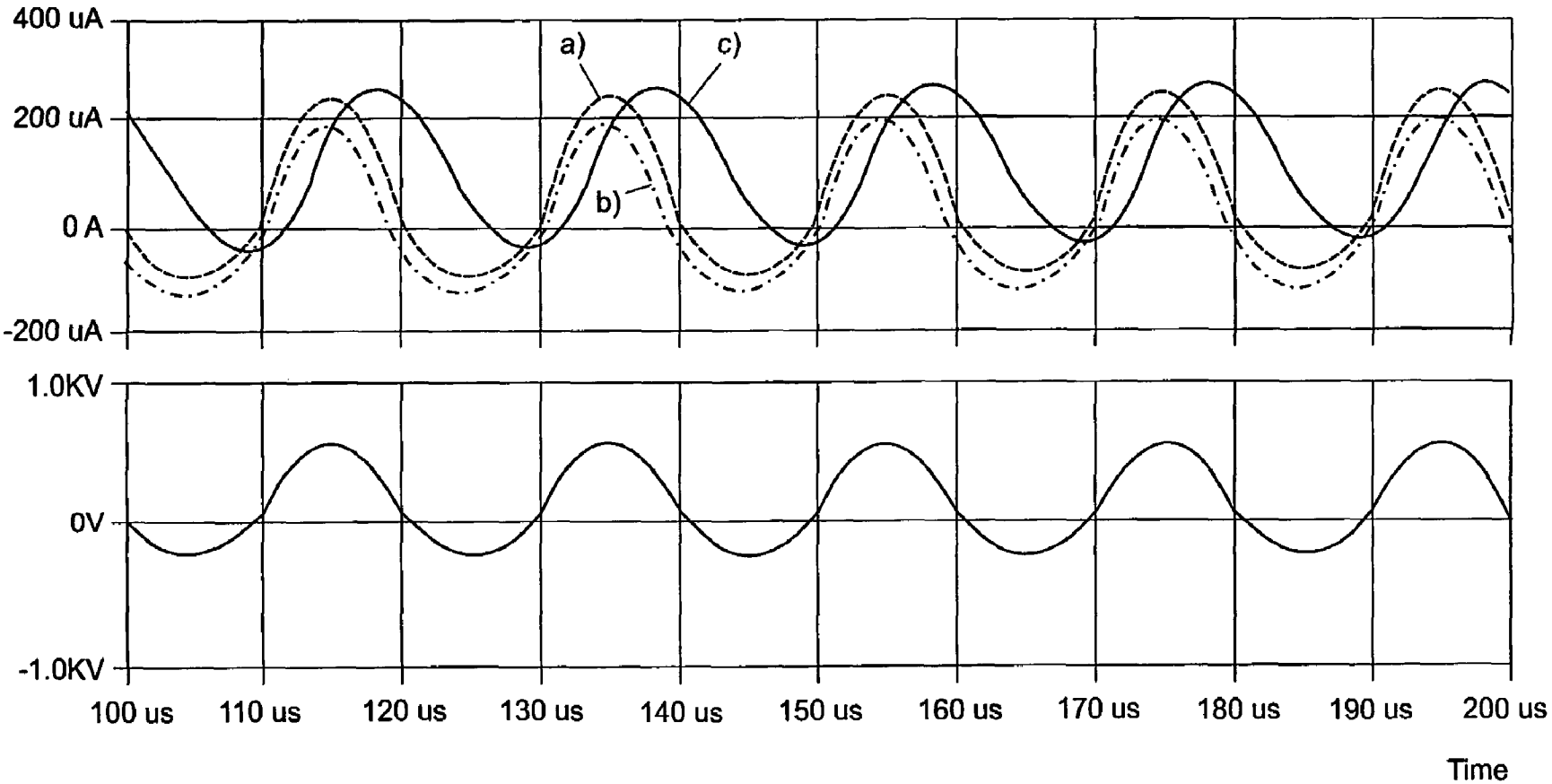
FIG. 2 shows the waveform of the lamp voltage and the current at the input of the protective circuit with unchanged, increased and reduced sensitivity.

FIG. 2 shows, in the lower graph, the waveform of the lamp voltage $U_{10}$ and, in the upper graph, the waveform of the first or second current $I_{mod}$ provided at the output 24 of the modification apparatus 22 without modification (curve a)), with reduced sensitivity (curve b)), and with increased sensitivity (curve c)). The higher the sensitivity the earlier an end-of-life disconnection is carried out.

The invention claimed is:

1. A circuit arrangement having a drive circuit (12) for a lamp (10) having a first connection (11) for a first filament (W1) of the lamp (10) and a second connection (13) for a second filament (W2) of the lamp (10);

a protective circuit (16), which is coupled on the output side to the drive circuit (12) and on the input side to the first connection for the first filament (W1) of the lamp and the second connection for the second filament (W2) of the lamp such that a first signal, which is correlated with an operational parameter of the first filament (W1), and a second signal, which is correlated with an operational parameter of the second filament (W2), can be transmitted to the protective circuit (16), characterized in that the circuit arrangement also comprises a modification apparatus (22) which is connected between the protective circuit (16) and the first connection (18) and the second connection (20), the modification apparatus (22) being designed to split the first signal and the second signal into a DC component and a AC component for the purpose of providing a modified first signal and a modified second signal.

2. The circuit arrangement as claimed in claim 1, characterized in that the modification apparatus (22) is designed to apply different weightings to the DC component and the AC component of the respective signal for the purpose of providing the modified first signal and the modified second signal.

3. The circuit arrangement as claimed in claim 2, characterized in that the modification apparatus (22) is designed to carry out frequency-dependent weighting.

4. The circuit arrangement as claimed in claim 1, characterized in that the modification apparatus (22) is designed to carry out frequency-dependent weighting.

5. The circuit arrangement as claimed in claim 1, characterized in that the modification apparatus (22) has an interface (26) in order to input at least one parameter for the modification.

* * * * *